US005852254A

United States Patent [19]

Wardecki

[11] Patent Number: 5,852,254

[45] Date of Patent: Dec. 22, 1998

[54] PROTECTIVE MEANS FOR FAST-MOVING OBJECTS

[75] Inventor: Norbert Wardecki, Heuweiler, Germany

[73] Assignee: Buck Werke GmbH & Co., Bad Ueberkingen, Germany

[21] Appl. No.: 754,154

[22] Filed: Nov. 22, 1996

[30] Foreign Application Priority Data

Nov. 22, 1995 [DE] Germany ..... 195 43 489.7

[51] Int. Cl.[6] ..... F42B 4/20; F41H 13/00

[52] U.S. Cl. ..... 102/342; 102/336; 102/355; 102/502; 342/1; 342/4; 89/1.11

[58] Field of Search ..... 102/336, 342, 102/348, 355, 502; 342/1, 4; 89/1.11

[56] References Cited

U.S. PATENT DOCUMENTS

| | | | |
|---|---|---|---|
| 2,628,836 | 2/1953 | Gangel | 273/360 |
| 4,286,498 | 9/1981 | Block et al. | 86/1 R |
| 4,852,456 | 8/1989 | Thornburg | 89/1.51 |
| 4,926,751 | 5/1990 | Wittman et al. | 102/348 |
| 5,042,390 | 8/1991 | Schotter | 102/504 |
| 5,317,163 | 5/1994 | Obkircher | 250/495.1 |
| 5,409,187 | 4/1995 | Dunham | 244/149 |
| 5,546,863 | 8/1996 | Joslyn | 102/504 |

*Primary Examiner*—Peter A. Nelson
*Attorney, Agent, or Firm*—Hill & Simpson

[57] ABSTRACT

Protective device for protection of rapidly moving objects such as aircraft or the like against homing heads that react to radiation, in particular infrared radiation, emitted by the aircraft, and that have a destructive charge. The protective device has at least one dispenser arranged on the object to be protected, and at least one effective body (flare), such as a spot flare or the like, that can be launched therefrom. The effective body has at least one decoy charge that can be at least partially ignited at a distance from the object and which, upon decomposition, temporarily forms an apparent target body that spectrally simulates, in a way relevant to the homing head, the target signature of the object to be protected. The effective body (flare) has at least one mooring line that unfolds from a dispenser upon launching of the effective body (flare) and that can be connected with the dispenser at one free end, whose end facing away from its free end is essentially permanently connected to the effective body (flare).

18 Claims, 1 Drawing Sheet

DISPENSER
10
14
12
FLARE
16
AIRCRAFT

DISPENSER
10
14
12
FLARE
16
AIRCRAFT

DISPENSER
10
14
12
FLARE
16
AIRCRAFT

DISPENSER
10
14
12
FLARE
16
AIRCRAFT

PROTECTIVE MEANS FOR FAST-MOVING OBJECTS

BACKGROUND OF THE INVENTION

The present invention concerns a protective means for fast-moving objects, such as aircraft, against homing heads that react to emitted radiation, in particular infrared radiation. The protective means has a dispenser arranged on the object to be protected, from which at least one effective body comprising a decoy charge can be launched.

In known protective or launch devices of this type, such as are known for example from German reference DE-PS 29 36 861, a launch system is arranged on the aircraft to be protected, from which effective bodies (flares) are shot, which become effective at an advanceable safety distance from the object to be protected, in particular aircraft. These can be what are known as spot flares, which form an infrared apparent target when they become effective.

Since at the time when the decoy charge concerned becomes effective, thus after the effective body or, respectively, the spot flare has reached the safety distance from the aircraft, there is no longer any mechanical connection between the effective body (flare) and the dispenser attached to the aircraft or the like that is to be protected, there rapidly arises between the apparent target and the aircraft to be protected a relative motion of such a type, with rapidly increasing distance between the apparent target and the aircraft, that the homing head will recognize the apparent target as a false target and will thus abort. As a result, the effectiveness of apparent targets against newer-generation homing heads decreases sharply. The above-named problem also cannot be solved through prior art measures for improving the spectral characteristic of the apparent target, since for this purpose only the relative kinematics of the apparent target or, respectively, of the spot flare in relation to the object to be protected is responsible.

In order to deal with the above-described threat, what are known as propelled flares, which have their own drive, were developed, as were towed decoys, that is, permanently installed towed false signal emitters. However, both have the disadvantage that they are more expensive and more costly than the apparent target bodies in the form of spot flares.

It is indeed already known from German reference DE-PS 41 25 355 to provide a mechanical connection in the form of a mooring line between the launch body and the launch cup of a self-protective launch device. However, the specified mooring line is torn off from the object to be protected or, respectively, the launch cup located there, as soon as it has caused the ignition of the decoy charge of a smoke launch body or the like. Here as well, there subsequently arises a change in the distance between the object to be protected and the blossoming decoy charge, whereby however this does not lead to noticeable problems concerning homing heads or the like due to the relatively small velocity, namely of a tank.

From German reference DE-OS 23 57 769, a device on a jet aircraft for leading astray combat missiles equipped with infrared homing heads is already known. In the towing of the aircraft decoy, charges are brought to blossom, which however already have a very considerable velocity relative to the object to be protected at the moment of their blossoming, so that here as well there is the danger that the homing head recognizes the apparent target as a false target and aborts.

From Japanese reference JP I 203899 it is already known to tow an apparent target that radiates thermal energy behind an aircraft. However, there is no possibility of placing a large distance between the apparent target and the aircraft to be protected after the switching on of a homing head, namely through corresponding maneuvers of the aircraft or the like. Thus, there is the danger that the homing head detonates in too close proximity to the aircraft, insofar as the maneuvering possibility of the aircraft is not to be too negatively affected by the apparent target, as is the case for very long tow lines, whereby damage to the aircraft or disturbance of the actual target cannot reliably be excluded.

SUMMARY OF THE INVENTION

It is an object of the present invention to provide an improved protective means such that even kinematic-sensitive homing heads cannot recognize the apparent target that is thereby producible as a false target, or can do so only with difficulty, even given a rapidly moving object to be protected.

According to the present invention, this object is provided by a protective means having the following features: a dispenser arranged on the object to be protected, from which at least one effective body (flare) comprising a decoy charge can be launched, and a mooring line connecting the effective body with the dispenser, whereby the effective body is ignited upon leaving the dispenser, is towed along for a short time in the burning state, and is subsequently released in the burning state through detachment of the mooring line.

It can thereby be provided that the mooring line is of expandable construction.

The present invention further proposes that the speed of deployment of the mooring line can be adjusted, in particular by means of an unrolling brake means or the like provided on the effective body and/or on the dispenser.

Moreover, it can be provided that the mooring line is attached on the dispenser and/or on the effective body so as to be able to be torn off.

The present invention provides that the time of the detachment of the mooring line can be set.

Finally, it can also be provided that the effective length of the mooring line defining the distance from the object to be protected to the effective body is adjustable up until the detachment of the mooring line.

The present invention also provides that the speed of deployment of the mooring line can be adjusted, in particular by means of an unrolling brake means or the like provided on the effective body (flare) and/or on the dispenser.

It can also be provided that the mooring line is attached on the dispenser and/or on the effective body (flare) so as to be able to be torn off.

The present invention also provides that the time of tearing off of the mooring line, and thereby the release of the effective body (flare) from the object to be protected can be set.

It can thereby also be provided that the effective length of the mooring line defining the distance between the object to be protected and the effective body (flare) up until the release of the effective body (flare) is adjustable.

The present invention provides that the decoy charge of the effective body (flare) is partly ignitable already upon being launched from the dispenser.

The present invention is based on the surprising finding that even for newer-generation homing heads, in particular infrared homing heads, the recognition of an apparent target as a false target is made drastically more difficult, even given a rapidly moving object to be protected, by providing a mooring line between the object to be protected and the effective body (flare), which line tows the apparent target with the object to be protected for a short time, so that the apparent target temporarily moves with essentially the same speed as the aircraft or the like to be protected. After the bridging over of the safety region located between the effective body (flare) or, respectively, the spot flare, and the launcher system, and thereby the object to be protected, the effective body (flare) is supported via the mooring line, whereby if necessary it can also be ignited via the mooring line. The further separation of the effective body (flare), or, respectively, of the blossoming apparent target from the object to be protected, up until the complete release can be controlled by a purposeful temporal and spatial unwinding of the mooring line. Alternatively, for this purpose an elastic mooring line can also be provided, which after becoming taut enables a further separation, due to its expansion, up until the release, whereby the release can of course also ensue through a defined tearing off.

It is inventively achieved that the apparent targets produced by means of the protective means make a temporal and spatial motion of separation that cannot be detected by the homing head. In addition, there is the advantage that the launching of the effective bodies (flares) can ensue from existing launch systems, so that the known flare technology can continue to be used, with spectral modification if warranted.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figures 1, 2, 3, 4:
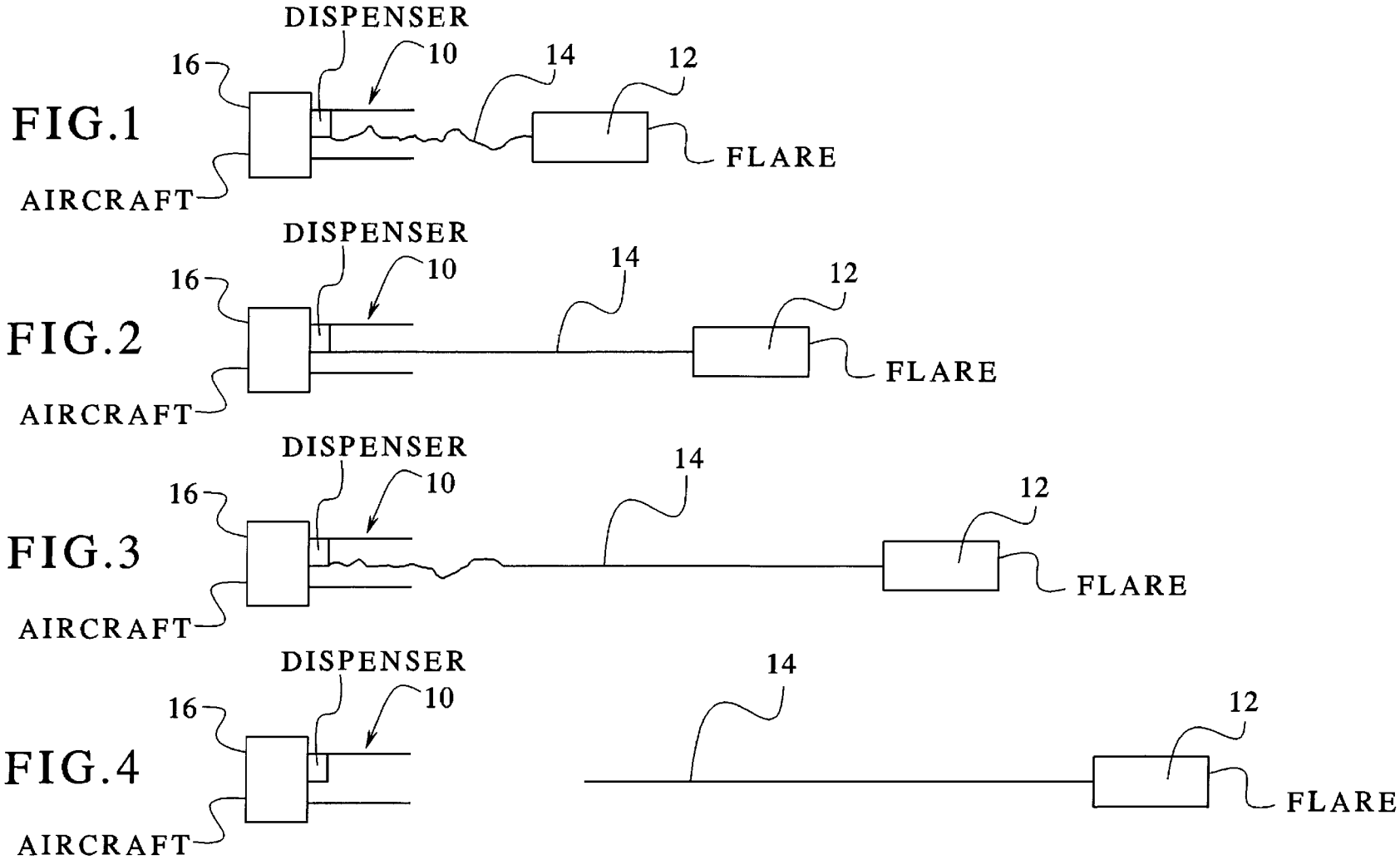
FIGS. 1–4 depict a launching means according to the invention in various states of operation.

In the state of the protective means shown in the drawing, an effective body (flare) 12, having a decoy charge that produces infrared radiation, has just been launched from a dispenser 10 attached to an aircraft 16 to be protected, whereby the ignition of the decoy charge ensues in the position shown in FIG. 1). As can be seen from FIG. 1) , a mooring line 14 rolls out from the dispenser 10. The mooring line 14 is attached at one end to the dispenser 10 and at the other end to the effective body (flare) 12.

FIG. 2 depicts a state in which the effective body (flare) 12 has left the safety area between the dispenser 10 or, respectively, the aircraft to be protected, whereby the effective body (flare) in the position shown in FIG. 2) is supported by the mooring line 14, which is becoming taut.

FIG. 3 depicts how the mooring line 14 can also further lengthen itself after the initial support in FIG. 2, possibly through the providing of a suitable unrolling means on the dispenser 10 and/or on the effective body (flare) 12, or also through the use of an elastically expandable mooring line. The effective body (flare) 12 can then be led behind the aircraft to be protected, not with a speed identical to that of the aircraft, but rather for example also with a lower relative speed.

Finally, FIG. 4 the effective body (flare) 12 being released through tearing off of the mooring line 14.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A protective device for fast-moving objects against homing heads that react to emitted radiation, comprising:

a dispenser arranged on the object to be protected, from which at least one effective body having a decoy charge is launchable; and a mooring line connecting the effective body with the dispenser and being deployed upon launching of said decoy charge, whereby the effective body ignites upon leaving the dispenser in close proximity of the object to be protected, is towed along for a short time in a burning state both with said mooring line not being fully employed and with fully deployed mooring line, and is subsequently released in the burning state through detachment of the mooring line.

2. The protective device according to claim 1, wherein the mooring line has an expandable construction.

3. The protective device according to claim 1, wherein a speed of deployment of the mooring line is adjustable by an unrolling brake device provided on at least one of the effective body and the dispenser.

4. The protective device according to claim 1, wherein the mooring line is attached to at least one of the dispenser and the effective body so as to be able to be torn off.

5. The protective device according to claim 1, wherein a time for detachment of the mooring line is settable.

6. The protective device according to claim 1, wherein an effective length of the mooring line defining a distance from the object to be protected to the effective body, up until detachment of the mooring line, is adjustable.

7. The protective device according to claim 1, wherein the fast-moving objects are aircraft.

8. The protective device according to claim 1, wherein the emitted radiation is infrared radiation.

9. A protective device for aircraft, against homing heads that react to infrared radiation, comprising:

a dispenser arranged on the aircraft, from which at least one effective body having a decoy charge is launchable; and a mooring line connecting the effective body to the dispenser and being deployed upon launching of said decoy charge, whereby the effective body ignites immediately upon leaving the dispenser in close proximity of the object to be protected, is towed along for a short time in a burning state both with said mooring line not being fully employed and with fully deployed mooring line, and is subsequently released in the burning state through detachment of the mooring line.

10. The protective device according to claim 9, wherein the mooring line has an expandable construction.

11. The protective device according to claim 9, wherein a speed of deployment of the mooring line is adjustable by an unrolling brake device provided on at least one of the effective body and the dispenser.

12. The protective device according to claim 9, wherein the mooring line is attached to at least one of the dispenser and the effective body so as to be able to be torn off.

13. The protective device according to claim 9, wherein a time for detachment of the mooring line is settable.

14. The protective device according to claim 9, wherein an effective length of the mooring line defining a distance from the object to be protected to the effective body, up until detachment of the mooring line, is adjustable.

15. A protective device for aircraft, against homing heads that react to infrared radiation, comprising:

a dispenser arranged on the aircraft, from which at least one effective body having a decoy charge is launchable;

a mooring line connecting the effective body to the dispenser and being deployed upon launching of said decoy charge, whereby the effective body ignites immediately upon leaving the dispenser in close proximity of the object to the protected, is towed along for a short time in a burning state both with said mooring line not being fully employed and with fully deployed mooring line, and is subsequently released in the burning state through detachment of the mooring line; and an unrolling brake device provided on at least one of the effective body and the dispenser, whereby a speed of deployment of the mooring line is adjustable.

16. The protective device according to claim 15, wherein the mooring line has an expandable construction.

17. The protective device according to claim 15, wherein a time for detachment of the mooring line is settable.

18. The protective device according to claim 15, wherein an effective length of the mooring line defining a distance from the object to be protected to the effective body, up until detachment of the mooring line, is adjustable.

* * * * *